United States Patent [19]

Harmsen

[11] Patent Number: 4,833,732

[45] Date of Patent: May 30, 1989

[54] COMFORT VEST AND COLLAR

[75] Inventor: Wayne A. Harmsen, Fond du Lac, Wis.

[73] Assignee: Arm-Kor Marketing Corporation, Eden, Wis.

[21] Appl. No.: 146,199

[22] Filed: Jan. 20, 1988

[51] Int. Cl.[4] ..... A41D 1/04

[52] U.S. Cl. ..... 2/102; 2/103

[58] Field of Search ..... 2/DIG. 7, 92, 102, 103, 2/133, 139, 125

[56] References Cited

U.S. PATENT DOCUMENTS

| | | | |
|---|---|---|---|
| 763,815 | 6/1904 | Uebel | 2/92 |
| 4,466,135 | 8/1984 | Coppage, Jr. | 2/103 |
| 4,510,626 | 4/1985 | Bowditch | 2/125 |
| 4,674,130 | 6/1987 | Coudron | 2/DIG. 7 |

OTHER PUBLICATIONS

The Journal of the American Medical Association, vol. 168, No. 7, Oct. 19, 1958, p. 930.

*Primary Examiner*—Henry S. Jaudon
*Assistant Examiner*—Jeanette E. Chapman
*Attorney, Agent, or Firm*—Donald Cayen

[57] ABSTRACT

A comfort vest has front and back panels that cover a person's chest and back. The vest is held in place by a pair of shoulder straps that join the front and back panels. One shoudler strap is split to create two seams. Releaseable fasteners attached to the seams permit closing the split shoulder strap over the wearer's shoulder. The comfort vest is reversible and may have a collar. The vest may be made of a moisture proof material for use as a bib. In a modified embodiment, only one shoulder strap is employed. Fastening means attached to the upper ends of the front and back panels join the panels directly to each other for draping over a shoulder. In a further modified version, the vest has very short front and back panels in combination with a collar.

4 Claims, 5 Drawing Sheets

COMFORT VEST AND COLLAR

BACKGROUND OF THE INVENTION

1. Field of the Invention

This invention pertains to wearing apparel, and more particularly to garments for covering the neck and upper torso.

2. Description of the Prior Art

Various items of clothing have been developed in attempts to combine warmth at a person's neck, check, shoulders, and back with attractiveness and ease of wearing. Examples of such articles may be seen in U.S. Pat. Nos. 837,143; 905,270; 2,269,491; 3,449,766; and 4,495,660.

The clothing disclosed in the foregoing patents are not entirely satisfactory. For instance, the neck and front piece of the U.S. Pat. No. 837,143 and the dickey of the U.S. Pat. No. 3,449,766 must be pulled over the wearer's head, thereby brushing against her face and disturbing her hairdo. The muffler of the U.S. Pat. No. 905,270 and the sweater of the U.S. Pat. No. 2,269,491 open at the front between chest flaps, which limits the versatility of the respective garments from the fashion standpoint and which renders the wearer's chest susceptible to cold and drafts. The garment of U.S. Pat. No. 4,495,660, being generally tubular in shape when closed, is designed primarily for covering only the neck and lower head rather than the chest and back. Further, none of the garments of the aforementioned patents is suitable as a separate and removeable collar for wearing with a collarless shirt.

Thus, a need exists for improved clothing for wearing around the chest, neck, and back.

SUMMARY OF THE INVENTION

In accordance with the present invention, a comfort vest is provided that is an advancement over prior garments worn about the upper torso and neck. This is accomplished by fabricating the vest with seamless front and back panels and with split but fastenable seams that overlie a person's shoulder.

The vest front and back panels are joined by a pair of relatively narrow straps. The straps overlie the wearer's shoulders, such that the front and back panels drape over the wearer's chest and back, respectively, and are suspended thereat by the two shoulder straps. One of the straps is seamless, thereby providing a direct connection between the front and back panels. The other strap is split to create generally facing seams. The split strap seams are releasably fastenable. When fastened, the split seams function like the seamless strap. However, the split feature permits donning and removing the vest from the side of the body without requiring that the vest pass over the wearer's head, or the removal of other clothing.

The split shoulder strap may be releasably fastened along the split seams by any suitable means. Preferably, the fastening means extends continuously along the strap seams.

The vest of the present invention is designed and manufactured to be very versatile. For that purpose, it is reversible. Further, it may be manufactured with or without a collar. The collar may be of various heights, ranging from a relatively narrow band to a wide turn-down style. In all instances, the collar is split in line with the seams of the split shoulder strap. The fastening means extends along substantially the entire length of the facing collar seams as continuations of the fastening means that extend along the seams of the split shoulder strap.

In a modified embodiment of the present invention, the front and back panels are joined by a single shoulder strap. The shoulder strap joins the upper ends of the panels to each other along respective first sides thereof for overlying a wearer's shoulder. Fasteners, such as Velcro fasteners, are attached to the panels near the upper ends of their respective second sides. When worn, the upper ends of the second sides of the two panels, being fastened to each other by means of the Velcro strips, overlie the person's other shoulder.

In a further modified version of the present invention, the front and back panels are greatly reduced in size, such that their respective lower edges are colinear with the outer edges of the shoulder straps. The collar may be of any desired type. In that manner, the appearance of a collared shirt or similar garment is presented without the weight and bulk attendant with an entire vest.

Other advantages, benefits, and features of the invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
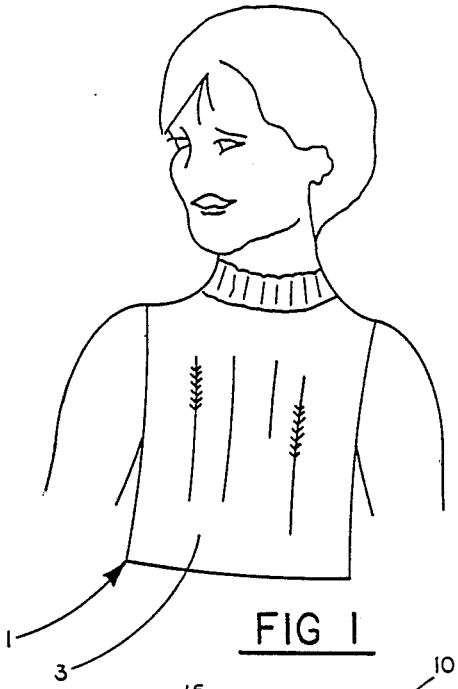
FIG. 1 is a perspective view of a person wearing the comfort vest of the present invention.

Referring to FIG. 1, a comfort vest 1 is illustrated that includes the present invention. The comfort vest is designed to be worn under an outer garment, not shown, to insulate a person's neck, shoulders, and upper chest and back. Portions of the vest 1 may be exposed from the outer garment for providing an attractive appearance around the neck and shoulders. Looking also at FIGS. 2 and 3, the comfort vest 1 comprises a generally rectangular front panel 3, a generally rectangular back panel 5, and a pair of shoulder straps 7 and 9 that connect the front and back panels. The front and back panels 3 and 5, respectively, are shown in a size that protects and insulates substantial areas of the wearer's chest and back. However, it will be understood that panels having smaller areas, as well as non-rectangular shapes, may be employed if desired. Further, the straps 7 and 9 may be narrower or wider than illustrated, i.e., the straps may terminate higher or lower on the wearer's shoulders than is illustrated.

Figure 2:
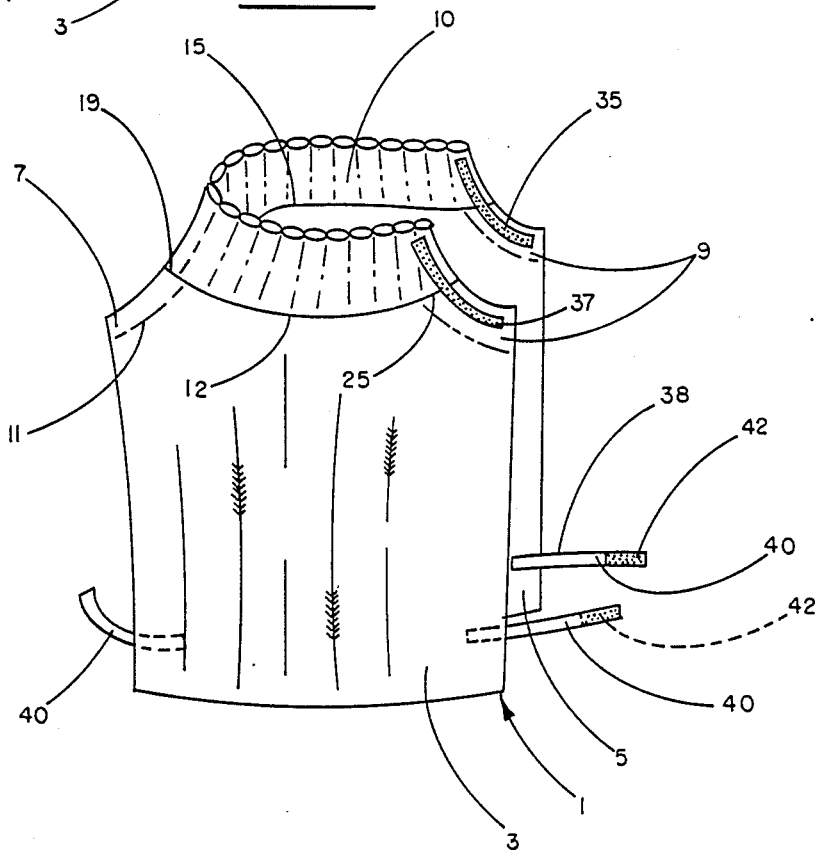
FIG. 2 is an enlarged perspective view of the comfort vest of the present invention in an open configuration ready to be donned by a wearer.
Figure 3:
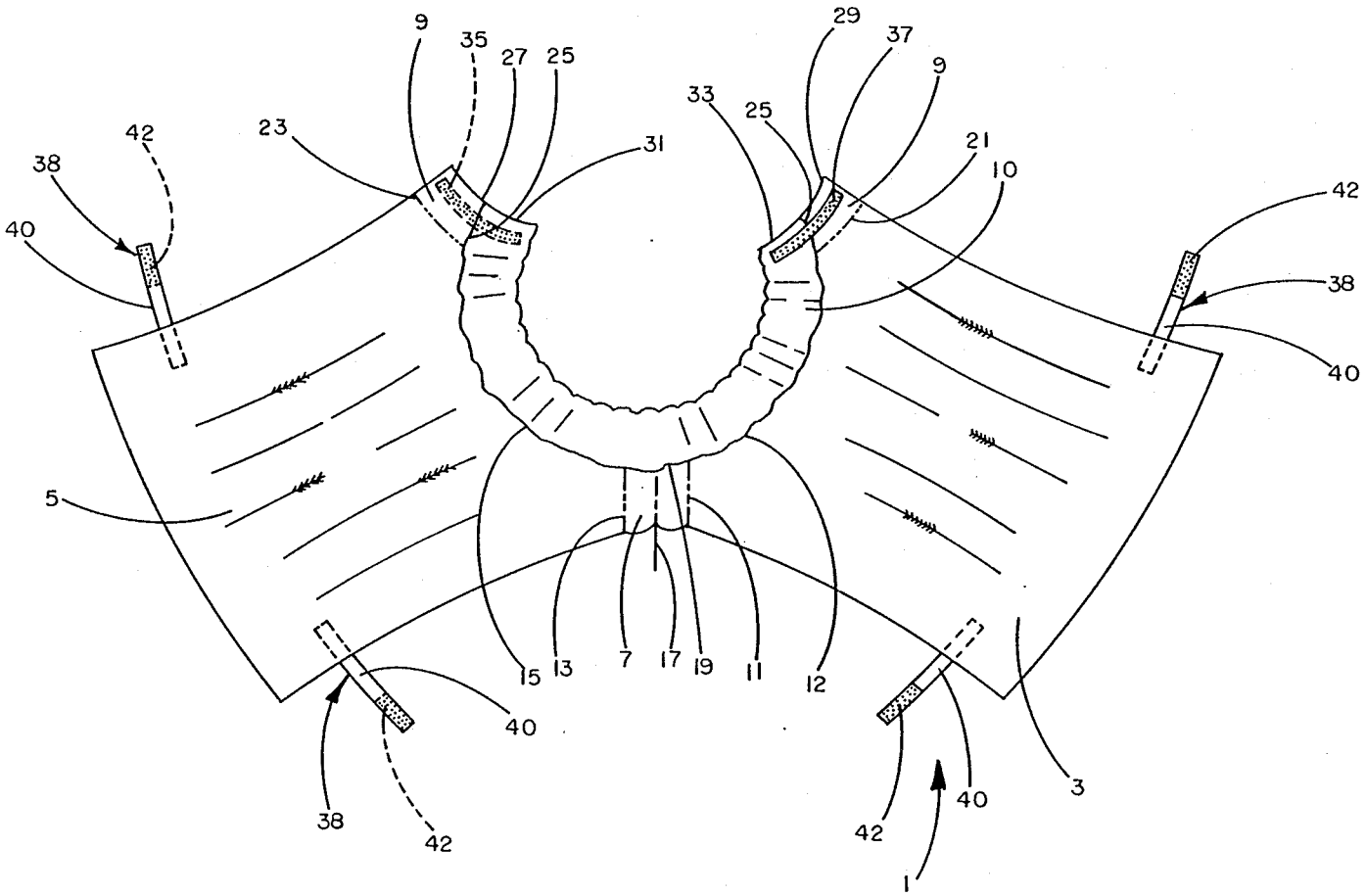
FIG. 3 is an enlarged top view of the vest opened to a flat condition.

The upper portions of the front and back panels 3 and 5, respectively, and the shoulder straps 7 and 9 may terminate in a collar 10. The collar 10 may be a separate piece of material joined, as by stitching, along lines 12 and 15 to the front and back panels, respectively, and along lines 19 and 25 to the shoulder straps 7 and 9, respectively. Alternately, the collar may be an integral continuation of the panels and straps such that there is no clear line of demarcation corresponding to the lines 12, 15, 19, and 25 between the collar, panels, and straps. The collar may be of any desired height, including a high fold down type. In FIGS. 1–3, a separate collar of intermediate height is shown for illustrative purposes.

The shoulder strap 7 and front panel 3 meet along a common line 11. The strap 7 and the back panel 5 meet along another common line 13. The lines 11 and 13 are approximately symmetrical about a vest transverse center line 17. The front panel 3 and the shoulder strap 9 meet along a common line 21. The back panel 5 and the strap 9 meet along a common line 23.

In the illustrated construction, the shoulder strap 9 is split at approximately its transverse midpoint into two generally facing seams 27 and 29. The collar 10 is also split to form seams 31 and 33 that are colinear with the strap seams 27 and 29, respectively. When the vest 1 is laid flat to an open configuration, as in FIG. 3, the colinear seam lines 27, 31 form an angle of less than 180 degrees with the second colinear seam lines 29, 33.

Figure 7:
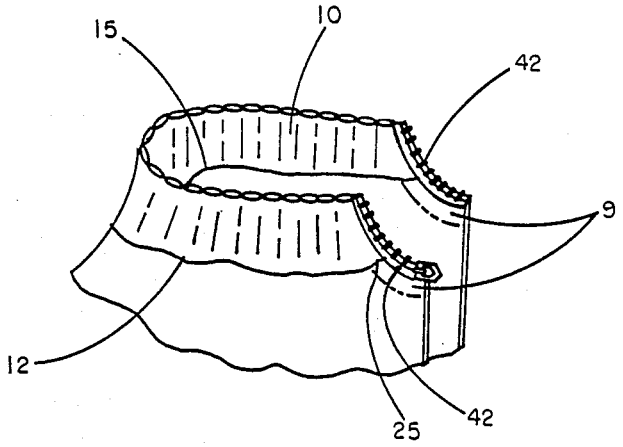
FIGS. 7–9 are partial perspective views showing alternate means for fastening the present invention.
Figure 8:
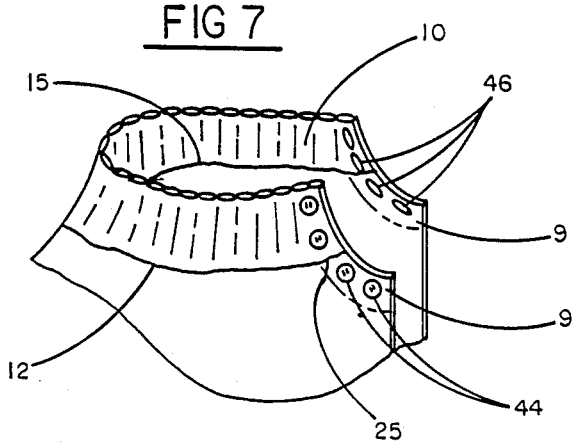
Figure 9:
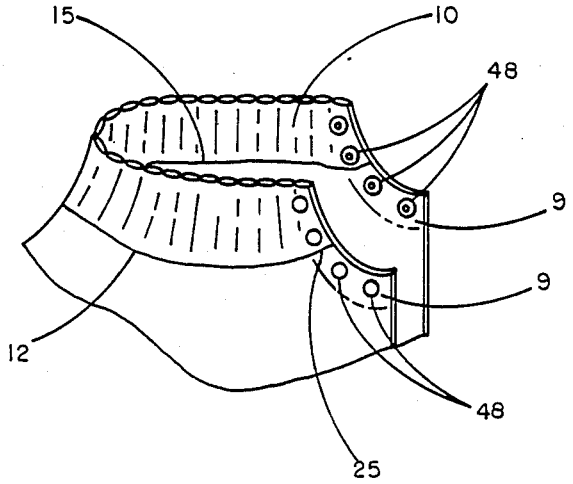

To join the seams 27, 31 to the seams 29, 33, respectively, any suitable releasable fastener may be used. However, a preferred fastener is a commercially available hook and loop tape sold under the trademark Velcro. In that instance, a first Velcro strip 35 is sewn or otherwise attached to the strap margin along the seams 27, 31. A second Velcro strip 37 is sewn to the strap margin along the seams 29, 33. The strips 35 and 37 are sewn to opposite faces of the vest 1, so that they are hidden from view when the strap margins are overlapped and the fasteners are placed into engagement. Referring to FIGS. 7–9, alternate fastening means are discussed. In FIG. 7, a zipper 42 is used as the fastener. In FIG. 8, a row of buttons 44 with matching buttonholes 46 serve as the fastening means. In FIG. 9, a series of mateable snaps 48 are shown. Conventional hooks and eyes, not illustrated, may also be used, if desired. As a result of the aforedescribed construction, the vest is capable of being put on and removed from the wearer's side, and it is not always necessary to first remove overlying clothing.

To help retain the comfort vest 1 in place on an active person, a pair of straps 38 may be secured to the opposite sides of each panel 3 and 5. The straps 38 comprise relatively long and narrow bands of flexible material 40 sewn to the front and back panels. The free ends of the bands 40 are provided with releasable fasteners 42, which may be Velcro fasteners. When the vest is in place on a person, the fasteners 42 of the associated straps cooperate to snugly hold the vest against the wearer's body.

Figure 4:
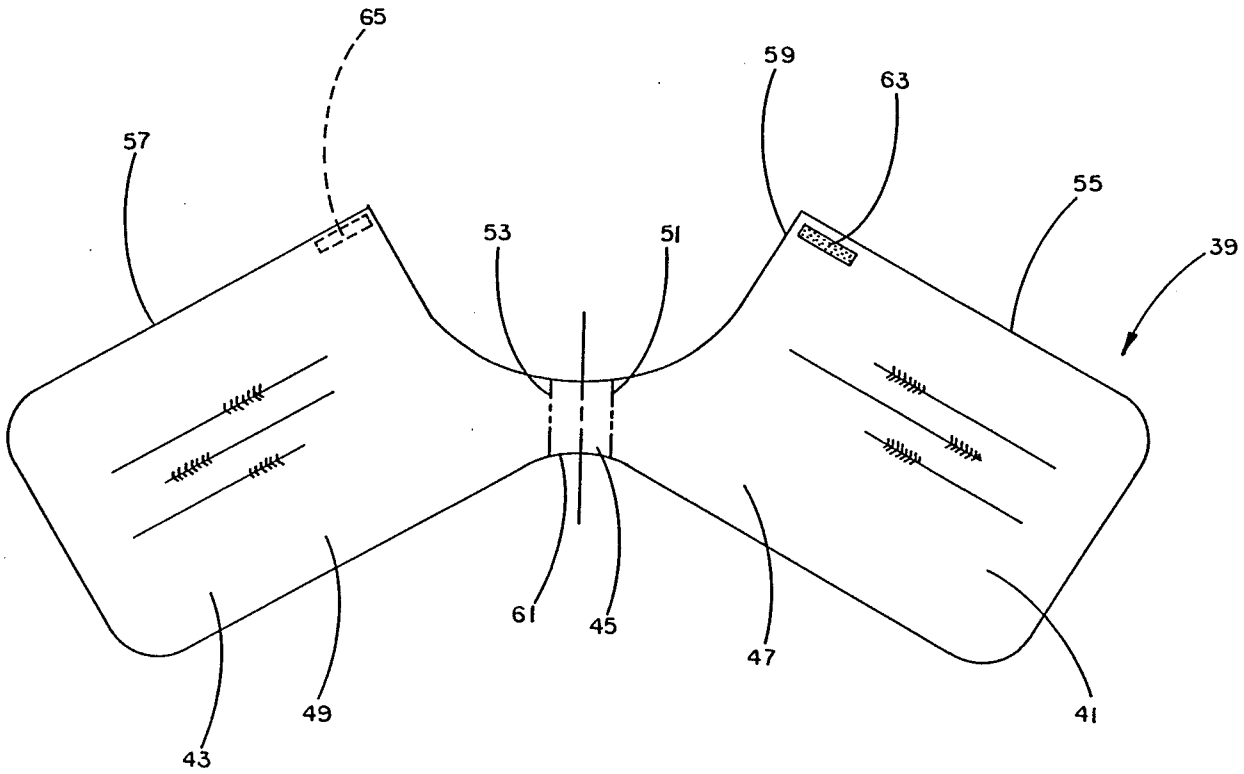
FIG. 4 is an enlarged top view of a modified embodiment of the present invention.

FIG. 4 depicts a modified form of the present invention. In FIG. 4, the comfort vest 39 is fabricated with a single shoulder strap. The vest 39 has a front panel 41, a back panel 43, and a shoulder strap 45 connecting first sides 47 and 49 of the panels 41 and 43, respectively. The shoulder strap 45 and the front panel first side 47 meet along a first common line 51. The shoulder strap and back panel first side 49 meet along a second common line 53. When laid flat in the position of FIG. 4, the front panel second side 55 and the back panel second side 57 form an angle of less than 180 degrees with one another. The vest 39 is preferably manufactured without a collar, so that the upper ends of the front and back panels and the shoulder strap terminate in a common neckline 59. The distance between the neckline 59 and the shoulder strap lower edge 61 may be relatively short.

To join the second sides 55 and 57 of the front and back panels 41 and 43, respectively, releasable fasteners are employed. Velcro brand fasteners are suitable. The Velcro fasteners 63 and 65 are sewn to the margins of the front and back panel sides 55 and 57 near the upper ends thereof and on opposite faces of the respective panels. If desired, the Velcro fasteners may alternately be sewn adjacent the upper end of the panels so as to be perpendicular to the panel sides. When worn, the margins of the upper ends of the front and back panels overlap, such that the Velcro fasteners 63 and 65 engage one another to hold the vest on a person's shoulder. The shoulder strap 45, of course, overlies the wearer's other shoulder. Placing the Velcro fasteners on opposite faces of the vest panels allows the fasteners to be fastened and to remain hidden when the vest is reversed. It will be appreciated that any of the button, zipper, or snap fasteners of FIGS. 7–9 may be used in place of the Velcro strips, if desired.

The comfort vest 1 may be made from any suitable material. A preferred material is a knit woolen yarn. The combination of that material with the seamless front panel 3 and front portion of the collar 10 provides maximum warmth and protection to the wearer's chest and throat. Other acceptable materials include woven natural textiles such as cotton, synthetics such as rayon and nylon, and blends of natural and synthetic materials. Vests made from those materials may be made from single piece blanks cut or sheared from a stack of multiple layers of the material.

The vest 1 of the present invention is eminently suitable for use as a bib by persons with poor muscle coordination. For that purpose, the vest may be manufactured with the back panel 5 having a relatively smaller size and the front panel 3 having a relatively larger size than are shown in FIGS. 1–4. For example, the front panel may extend downwardly over the abdomen and lap of a seated person. For use as a bib, the vest material is preferably a moisture impervious or resistant synthetic, such as Mylar or Dacron material. It is anticipated that a collarless version of the product illustrated in FIGS. 1–3 would be most suitable for application as a bib.

Figure 5:
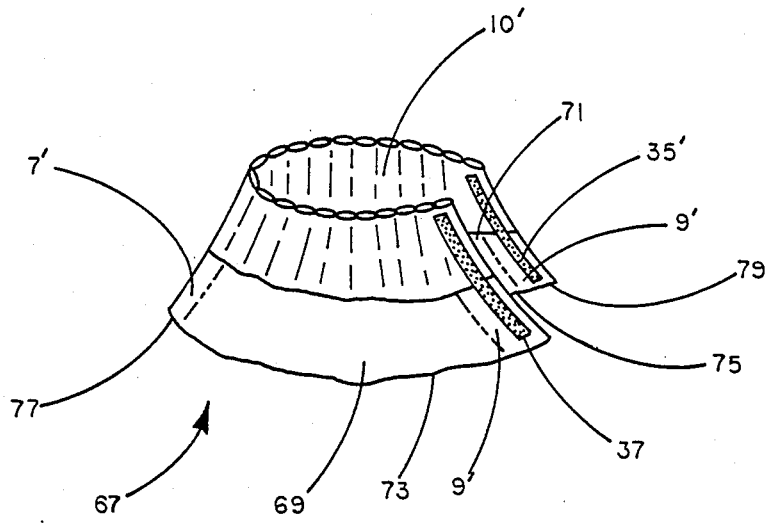
FIG. 5 is a perspective view of a further modified embodiment of the present invention.
Figure 6:
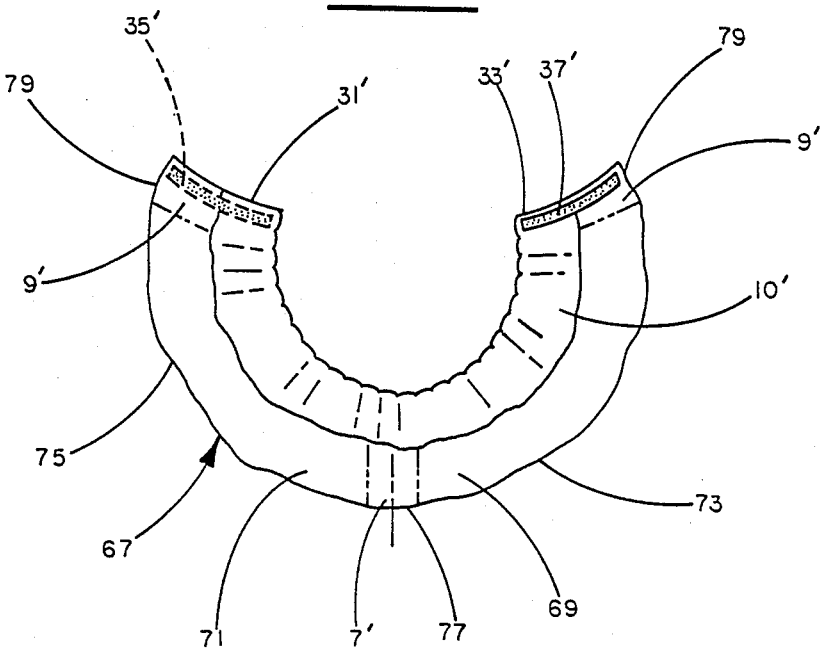
FIG. 6 is a top view of the garment of FIG. 5 opened to a flat configuration.

As mentioned previously, the vest 1 may have a front and back panels sized substantially smaller than illustrated in FIGS. 1–4. Turning to FIGS. 5 and 6, a modified garment 67 is depicted wherein the front panel 69 and the back panel 71 consist of relatively narrow bands. The bottom edges 73 and 75 of the front and back panels 69 and 71, respectively, are generally colinear with the outer edges 77 and 79 of the suspender straps 7' and 9', respectively. The garment 67 normally includes a collar 10'. It is expected that the collar 10' would be of a fold down type, although that design is not essential. The facing seams 31' and 33' of the split shoulder strap 9' are provided with Velcro strips 35' and 37', respectively, for joining the bands 69 and 71. The garment 67 is designed to give the appearance of a collared shirt, sweater, or other clothing article without the bulk and weight associated with the vest as described in connection with FIGS. 1-4.

Thus, it is apparent that there has been provided, in accordance with the invention, a comfort vest and collar that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A comfort vest comprising:

a. a seamless front panel having upper and lower ends and first and second sides;

b. a seamless back panel having upper and lower ends and first and second sides;

c. a first shoulder strap joining the upper end of the first side of the front panel to the upper end of the first side of the back panel;

d. a second shoulder strap joining the upper end of the second side of the front panel to the upper end of the second side of the back panel, the second shoulder strap being split so as to create two shoulder strap seams;

e. fastening means attached to the second shoulder strap adjacent the seams thereof for releasably fastening the seams together, the fastening means comprising a pair of strips of Velcro material fastened to the second shoulder strap adjacent the respective seams thereof, the Velcro strips being placed substantially parallel to the seams;

f. a collar joined to the upper ends of the front and back panels and to the first and second shoulder straps, the collar being split to have a pair of seams that are continuations of the respective seams of the second shoulder strap; and g. a pair of Velcro strips fastened to the collar adjacent the seams thereof, the Velcro strips being placed substantially parallel to the collar seams, so that a person can don and remove the vest from the side of the body by opening and closing the split shoulder strap seams.

2. A comfort vest comprising:

a. a seamless front panel having upper and lower ends and first and second sides;

b. a seamless back panel having upper and lower ends and first and second sides;

c. a first shoulder strap joining the upper end of the first side of the front panel to the upper end of the first side of the back panel;

d. a second shoulder strap joining the upper end of the second side of the front panel to the upper end of the second side of the back panel, the second shoulder strap being split so as to create two shoulder strap seams;

e. fastening means attached to the second shoulder strap adjacent the seams thereof for releasably fastening the seams together, wherein the fastening means comprises a pair of straps of Velcro material fastened to the second shoulder strap adjacent the respective seams thereof, the Velcro strips being placed substantially parallel to the seams; and f. a collar joined to the upper end of the front and back panels and to the first and second shoulder straps, the collar being split to have a pair of seams that are continuous of the respective seams of the second shoulder strap, the Velcro fasteners being further attached to the collar adjacent the seams thereof, so that a person can don and remove the vest from the side of the body by opening and closing the split shoulder strap seams.

3. A clothing article comprising:

a. a front band having first and second sides;

b. a back band having first and second sides;

c. a first shoulder strap joining the first side of the front band to the first side of the back band;

d. a second shoulder strap joining the second side of the front band to the second side of the back band, the second shoulder strap being split so as to create two shoulder strap seams;

e. a collar joined to the front and back bands and to the first and second shoulder strips, the collar being split to have a pair of seams that are continuations of the respective seams of the second shoulder strap; and f. fastening means attached to the second shoulder strap and to the collar adjacent the respective seams thereof for releasably fastening the seams together, so that the clothing article may be worn around a person's neck to give a collared appearance.

4. The clothing article of claim 3 wherein the fastener means comprises a pair of strips of Velcro material fastened to the second shoulder strap and to the collar adjacent the respective seams thereof, the Velcro strips being placed substantially parallel to the seams.

* * * * *